US009123268B2

(12) United States Patent
Uehara

(10) Patent No.: US 9,123,268 B2
(45) Date of Patent: Sep. 1, 2015

(54) CONTROLLER, OPERATION METHOD, AND STORAGE MEDIUM

(75) Inventor: Naotaka Uehara, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 510 days.

(21) Appl. No.: 13/569,446

(22) Filed: Aug. 8, 2012

(65) Prior Publication Data

US 2013/0113396 A1 May 9, 2013

(30) Foreign Application Priority Data

Aug. 11, 2011 (JP) ..... 2011-176106

(51) Int. Cl.

| | |
|---|---|
| ***H05B 37/00*** | (2006.01) |
| ***G09F 13/34*** | (2006.01) |
| ***G10H 1/00*** | (2006.01) |
| ***G10H 1/32*** | (2006.01) |
| ***G10D 13/00*** | (2006.01) |

(52) U.S. Cl.

CPC ..... *G09F 13/34* (2013.01); *G10D 13/003* (2013.01); *G10H 1/00* (2013.01); *G10H 1/32* (2013.01)

(58) Field of Classification Search

CPC .. G10D 13/003; H05B 37/02; H05B 37/0227; H05B 37/029

USPC ..... 84/422.1, 422.4; 315/312, 313, 317, 315/318, 319

See application file for complete search history.

(56) References Cited

U.S. PATENT DOCUMENTS

| | | | | |
|---|---|---|---|---|
| 6,423,891 | B1 * | 7/2002 | Zengerle | 84/422.4 |
| 7,135,637 | B2 * | 11/2006 | Nishitani et al. | 84/723 |
| 7,179,984 | B2 | 2/2007 | Nishitani et al. | |
| 7,183,480 | B2 | 2/2007 | Nishitani et al. | |
| 7,781,666 | B2 | 8/2010 | Nishitani et al. | |
| 8,106,283 | B2 | 1/2012 | Nishitani et al. | |

(Continued)

FOREIGN PATENT DOCUMENTS

| | | | |
|---|---|---|---|
| CN | 201191492 | Y | 2/2009 |
| JP | 2001-215963 | A | 8/2001 |

(Continued)

OTHER PUBLICATIONS

Japanese Office Action dated Sep. 3, 2013 (and English translation thereof) in counterpart Japanese Application No. 2011-176106.

(Continued)

*Primary Examiner* — Jeffrey Zweizig

(74) *Attorney, Agent, or Firm* — Holtz, Holtz, Goodman & Chick PC

(57) ABSTRACT

A stick-type controller 21 comprises an acceleration sensor 61 that obtains acceleration values generated in respective directions of the X-axis, the Y-axis, and the Z-axis, LEDs 64 that emit light corresponding to the acceleration values on the X-axis, the Y-axis, and the Z-axis obtained by the acceleration sensor 61, and a CPU 63 that controls the light emission of the LEDs 64. Further, if the acceleration values obtained by the acceleration sensor 61 are not a value that can be regarded as 0 on at least one axis among the three axes of the X-axis, the Y-axis, and the Z-axis of the stick-type controller 21, the CPU 63 causes the LEDs 64 to emit light in a color corresponding to the axis or axes on which an acceleration value other than a value that can be regarded as 0 was obtained.

8 Claims, 7 Drawing Sheets

(56) References Cited

U.S. PATENT DOCUMENTS

| | | | | |
|---|---|---|---|---|
| 8,168,875 | B2 * | 5/2012 | Stockli | 84/422.4 |
| 8,198,526 | B2 * | 6/2012 | Izen et al. | 84/743 |
| 8,801,521 | B2 * | 8/2014 | Haga et al. | 463/37 |

FOREIGN PATENT DOCUMENTS

| | | | |
|---|---|---|---|
| JP | 2001-347080 | A | 12/2001 |
| JP | 2002-023742 | A | 1/2002 |
| JP | 2002-203401 | A | 7/2002 |
| JP | 2004-133365 | A | 4/2004 |

OTHER PUBLICATIONS

Chinese Office Action dated Mar. 24, 2014 in counterpart Chinese Application No. 201210287256.6.

* cited by examiner

| LUMINOUS COLOR TABLE FOR ACCELERATION | |
|---|---|
| AXIAL COMPONENT | LUMINOUS COLOR |
| X | R (RED) |
| Y | G (GREEN) |
| Z | B (BLUE) |
| X + Y | Y (YELLOW) |
| Y + Z | C (CYAN) |
| X + Z | M (MAGENTA) |
| X + Y + Z | W (WHITE) |

| LUMINOUS COLOR TABLE FOR ANGULAR VELOCITY | |
|---|---|
| AXIAL COMPONENT | LUMINOUS COLOR |
| X | G (GREEN) + B (BLUE) = C (CYAN) |
| Y | R (RED) + B (BLUE) = M (MAGENTA) |
| Z | R (RED) + G (GREEN) = Y (YELLOW) |

CONTROLLER, OPERATION METHOD, AND STORAGE MEDIUM

This application is based upon and claims the benefit of priority from the prior Japanese Patent Application No. 2011-176106, filed Aug. 11, 2011, and the entire contents of which are incorporated herein by reference.

BACKGROUND OF THE INVENTION

1. Field of the Invention

The present invention is related to a controller that changes a luminous color in accordance with a direction in which a performer swings the controller, as well as an operation method and storage medium.

2. Related Art

Conventionally, a stick-shaped display device in which an acceleration sensor and a light emitter are incorporated has been proposed, wherein the display device expresses changes in a physical quantity as color changes by switching a luminous color of the light emitter in response to changes in a physical quantity such as a slight positional change relative to the direction of the earth's gravity or reciprocating motion based on the direction of gravity (JP 2004-133365 A).

However, in the stick-shaped display device disclosed in JP 2004-133365 A, the luminous color merely changes due to tilting relative to the direction of gravity, and thus it was difficult to determine if a correct hit was administered.

The present invention was created in light of such circumstances, and an objective thereof is to provide a controller that changes a luminous color in accordance with a movement direction relative to an axis set in the stick itself, as well as an operation method and a storage medium.

SUMMARY OF THE INVENTION

In order to achieve the above-mentioned objective, a controller of one embodiment of the present invention is characterized by being provided with a stick-shaped holding member, an acceleration sensor that obtains accelerations generated in respective directions of three axes that are mutually orthogonal including an axis in the longitudinal direction of the holding member, a plurality of light emitters that are provided on the holding member corresponding to each of the three axes, wherein each light emitter is capable of emitting light in a different light-emitting form, and a light emission control unit that controls the light emission of the light emitters in accordance with the acceleration on each of the three axes obtained by the acceleration sensor.

An operation method of one embodiment of the present invention is a method for operating a controller including a stick-shaped holding member, an acceleration sensor that obtains accelerations generated in respective directions of three axes that are mutually orthogonal including an axis in the longitudinal direction of the holding member, and a plurality of light emitters that are provided on the holding member corresponding to each of the three axes, wherein each light emitter is capable of emitting light in a different light-emitting form, the method characterized by including the steps of:

obtaining accelerations generated in respective directions of the three axes from the acceleration sensor, and controlling light emission of the corresponding light emitters in accordance with the acceleration on each of the three axes.

Further, a computer-readable storage medium of one embodiment of the present invention stores a program causing a computer used in a controller including a stick-shaped holding member, an acceleration sensor that obtains accelerations generated in respective directions of three axes that are mutually orthogonal including an axis in the longitudinal direction of the holding member, and a plurality of light emitters that are provided on the holding member corresponding to each of the three axes, wherein each light emitter is capable of emitting light in a different light-emitting form, to execute the steps of obtaining accelerations generated in respective directions of the three axes from the acceleration sensor, and controlling light emission of the corresponding light emitters in accordance with the acceleration on each of the three axes.

DETAILED DESCRIPTION OF THE INVENTION

Below, an embodiment of the present invention will be explained with reference to the attached drawings.

Figure 1:
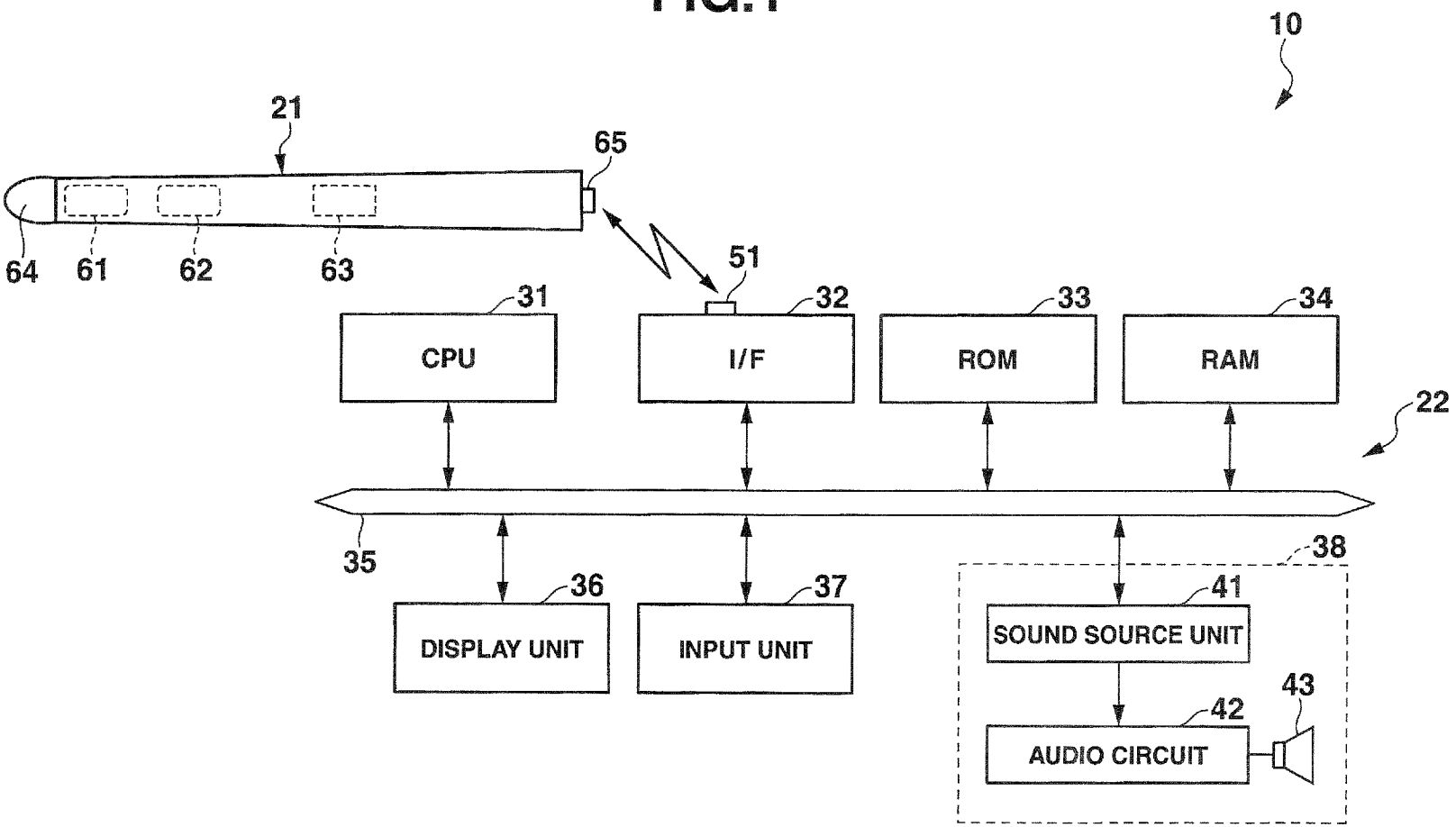
FIG. 1 is a block diagram illustrating a constitution of an electronic instrument according to an embodiment of the present invention.
Figure 2:
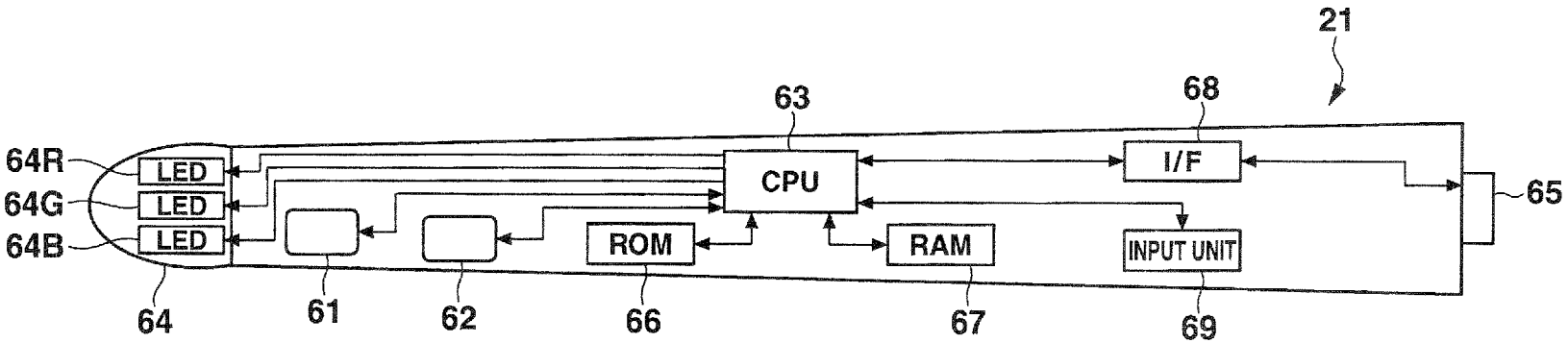
FIG. 2 is a block diagram illustrating a constitution of a stick-type controller 21 according to an embodiment of the present invention.

FIG. 1 is a block diagram illustrating a constitution of an electronic instrument according to an embodiment of the present invention. As shown in FIG. 1, an electronic instrument 10 according to the present embodiment includes a stick-type controller 21 extending in the longitudinal direction that is held in the hand of a performer and swung, and a sound-producing unit 22 for producing musical tones. The sound-producing unit 22 has a CPU (Central Processing Unit) 31, an interface (I/F) 32, a ROM (Read Only Memory) 33, a RAM (Random Access Memory) 34, a bus 35, a display unit 36, an input unit 37, and a sound system 38, and these are connected via the bus 35. As shown in FIG. 2 to be explained below, the stick-type controller 21 has an acceleration sensor 61, an angular velocity sensor 62, a CPU 63, LEDs 64, and an infrared-ray communication device 65, and the like.

The CPU 31 executes control of the entire electronic instrument 10. For example, the CPU 31 executes various processing such as control of the sound-producing unit 22 of the electronic instrument, control based on detection of operation of a key switch (not illustrated) that constitutes the input unit 37, control of production of musical tones based on data (for example, a note-on event) from the stick-type controller 21 received via the I/F 32, and the like.

The I/F 32 receives data from the stick-type controller 21 such as a note-on event, and stores the data in the RAM 34 and reports the receipt of data to the CPU 31. An infrared-ray communication device 51 is provided to the I/F 32. The infrared-ray communication device 51 of the I/F 32 receives infrared rays produced by the stick-type controller 21, and thereby the sound-producing unit 22 can receive data from the stick-type controller 21. Data communication is not limited to infrared-ray communication, and any method of communication (such as wireless communication or the like) can be used.

The ROM 33 stores various processing programs. For example, various processing programs for exhibiting a variety of functions, such as control of the entire electronic instrument 10, particularly control of the sound-producing unit 22 of the electronic instrument, detection of operation of a key switch (not illustrated) that constitutes the input unit 37, production of musical tones based on a note-on event received via the I/F 32, and the like are stored in the ROM 33. Also, the ROM 33 includes a waveform data area that stores waveform data of various tones, such as waveform data of wind instruments like a flute, a saxophone, and a trumpet, keyboard instruments like a piano, stringed instruments like a guitar, and percussion instruments like a bass drum, a hi-hat, a snare, cymbals, and a tom.

The RAM 34 stores various data such as programs that are read out from the ROM 33, data produced during the course of processing, and parameters. Data produced during the course of processing includes the operation state of the switch of the input unit 37, sensor values and the like received via the I/F 32, the sound-production state (sound-production flag) of musical tones, and the like.

The display unit 36 is constituted by, for example, a liquid crystal display device, and can display selected tones, volumes, and the like as images. The input unit 37 has various switches (not illustrated).

The sound system 38 includes a sound source unit 41, an audio circuit 42, and a speaker 43. The sound source unit 41 reads out waveform data from the waveform data area of the ROM 33 in accordance with an instruction from the CPU 31 to generate and output musical tone data. The audio circuit 42 converts the musical tone data output from the sound source unit 41 into an analog signal, amplifies the converted analog signal, and outputs it to the speaker 43. Thereby, musical tones are output from the speaker 43.

FIG. 2 is a block diagram illustrating a constitution of the stick-type controller 21 according to the present embodiment. As shown in FIG. 2, the stick-type controller 21 has the acceleration sensor 61, the angular velocity sensor 62, the CPU 63, the LEDs 64, the infrared-ray communication device 65, a ROM 66, a RAM 67, an interface (I/F) 68, and an input unit 69.

The acceleration sensor 61 is, for example, a three-axis sensor of the capacitance type or the piezoresistor type, and can output respective acceleration values representing the acceleration generated in each of the three axial directions of X, Y, and Z to be explained later. The acceleration sensor 61 is provided on the distal end side of the stick-type controller 21, which is the opposite side relative to the base side which is held by the performer.

The angular velocity sensor 62 is, for example, a sensor including a gyroscope, and can output respective angular velocity values representing the angular velocity generated around each of the three axes X, Y, and Z to be explained later. The angular velocity sensor 62 is provided on the distal end side of the stick-type controller 21, which is the opposite side relative to the base side which is held by the performer. The position of the angular velocity sensor 62 is not limited to the distal end side, and it can be provided on the base side.

The CPU 63 executes control of the entire stick-type controller 21. For example, the CPU 63 obtains the acceleration values output by the acceleration sensor 61 and the angular velocity values output by the angular velocity sensor 62. Once obtained, the CPU 63 controls the light emission of an LED 64R, an LED 64G, and an LED 64B based on the acceleration values and the angular velocity values. The CPU 63 also detects the timing of sound production of musical tones based on the acceleration values, determines the volume in accordance with the acceleration values, and generates note-on events. In addition, the CPU 63 executes control of the transmission of note-on events via the I/F 68 and the infrared-ray communication device 65.

The LED 64 has a red LED 64R, a green LED 64G, and a blue LED 64B. The LEDs 64R, 64G, and 64B emit light by drive control from the CPU 63. The drive control of the LEDs 64R, 64G, and 64B is executed in accordance with drive data transmitted from the CPU 63 via a drive circuit 71 (refer to FIG. 6) to be explained later.

The infrared-ray communication device 65 is provided on the end at the base side of the stick-type controller 21, and transmits data from the stick-type controller 21 to the sound-producing unit 22 by transmitting infrared rays via the I/F 68 to be explained below to the infrared-ray communication device 51 on the sound-producing unit 22 side.

The ROM 66 stores various processing programs. For example, various processing programs for exhibiting a variety of functions, such as obtaining acceleration values of the stick-type controller 21 output by the acceleration sensor 61 and angular velocity values of the stick-type controller 21 output by the angular velocity sensor 62, light emission control of the LEDs 64R, 64G, and 64B based on the acceleration values and the angular velocity values, detecting of the timing of sound production of musical tones based on the acceleration values, determination of the volume in accordance with the acceleration values, generation of note-on events, control of transmission of note-on events via the I/F 68 and the infrared-ray communication device 65, and the like are stored in the ROM 66. The RAM 67 stores various data including values obtained or generated during processing, such as the acceleration values and angular velocity values, as well as tables to be explained later.

The I/F 68 outputs data to the infrared-ray communication device 65 in accordance with instructions from the CPU 63. The input unit 69 has switches (not illustrated).

Figure 3:
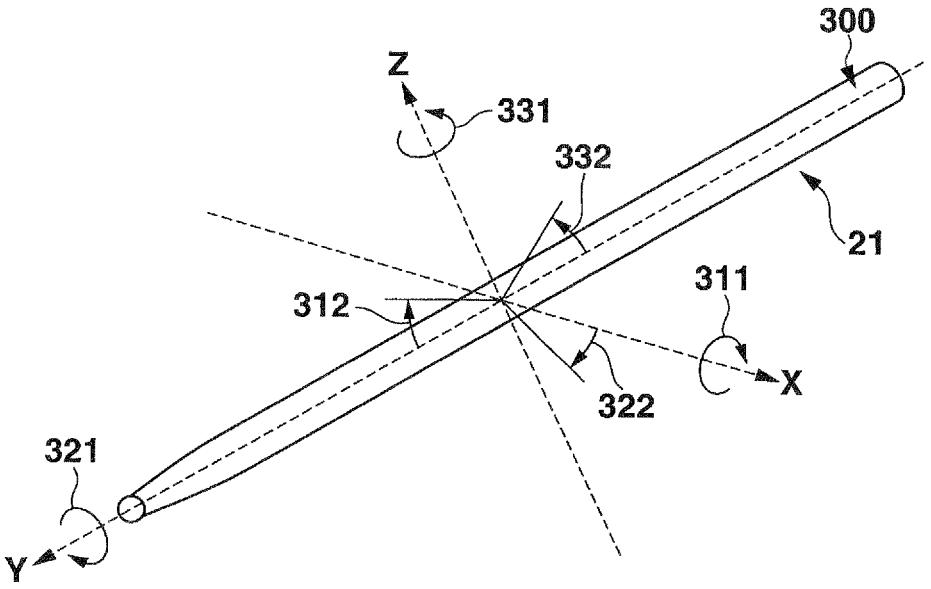
FIG. 3 is a perspective view illustrating a constitution of the outer appearance of the stick-type controller 21 according to an embodiment of the present invention.

FIG. 3 is a perspective view illustrating a constitution of the outer appearance of the stick-type controller 21 according to the present embodiment.

In FIG. 3, the Y-axis is the axis that matches the axis in the longitudinal direction of the stick-type controller 21. The X-axis is the axis that is parallel to a base plate (not illustrated) on which the acceleration sensor 61 is arranged and is orthogonal to the Y-axis. The Z-axis is the axis that is orthogonal to the X-axis and the Y-axis. The acceleration sensor 61 according to the present embodiment can obtain acceleration values for each component of the X-axis, the Y-axis, and the Z-axis.

In FIG. 3, a rotation angle 311 around the X-axis is the rotation angle around the lateral axis from the perspective of the performer when the performer holds the stick-type controller 21, and thus it is called a pitch angle. The pitch angle is an angle 312 showing the extent to which the stick-type controller 21 is tilted relative to the X-Y plane. The pitch angle changes when the performer holds the stick-type controller 21 at, for example, an area 300 on the base side and swings it in the up-down direction.

In FIG. 3, a rotation angle 321 around the Y-axis is the rotation angle around the antero-posterior axis from the perspective of the performer when the performer holds the stick-type controller 21, and thus it is called a roll angle. The roll angle is an angle 322 showing the extent to which the stick-type controller 21 is rotated around the Y-axis. The roll angle changes when the performer holds the stick-type controller 21 at, for example, the area 300 on the base side and rotates it left or right about the axis of the performer's wrist.

In FIG. 3, a rotation angle 331 around the Z-axis is the rotation angle around the vertical axis from the perspective of the performer when the performer holds the stick-type controller 21, and thus it is called a yaw angle. The yaw angle is an angle 332 showing the extent to which the stick-type controller 21 is tilted relative to the Y-Z plane. The yaw angle changes when the performer holds the stick-type controller 21 at, for example, the area 300 on the base side and swings it in the left-right direction on the axis of the performer's wrist.

Figures 4, 5:
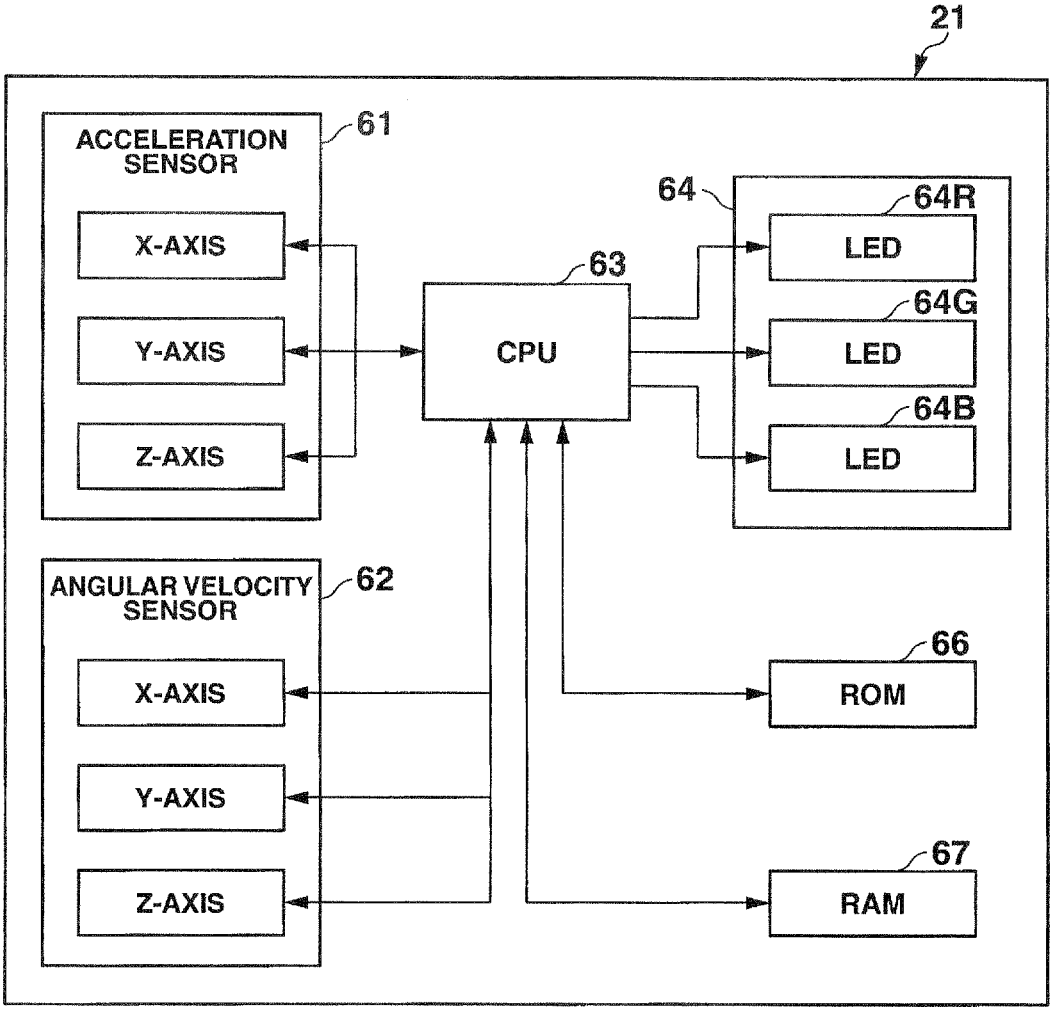
FIG. 4 is a block diagram illustrating a detailed constitution of the stick-type controller 21 according to an embodiment of the present invention.
FIG. 5 is a diagram showing a luminous color table for acceleration according to an embodiment of the present invention.

FIG. 4 is a block diagram illustrating a detailed constitution of the stick-type controller 21 according to the present embodiment. In FIG. 4, a portion of the constitution explained in FIG. 2 is illustrated in further detail.

When the acceleration sensor 61 detects acceleration in the X-axis direction, the CPU 63 generates drive data for causing the LED 64R to emit light at a brightness in accordance with the size of the acceleration in the X-axis direction, and transmits the drive data to the LED 64R. When the acceleration sensor 61 detects acceleration in the Y-axis direction, the CPU 63 generates drive data for causing the LED 64G to emit light at a brightness in accordance with the size of the acceleration in the Y-axis direction, and transmits the drive data to the LED 64G. When the acceleration sensor 61 detects acceleration in the Z-axis direction, the CPU 63 generates drive data for causing the LED 64B to emit light at a brightness in accordance with the size of the acceleration in the Z-axis direction, and transmits the drive data to the LED 64B.

When the stick-type controller 21 is in a stationary state, the acceleration sensor 61 is set to not detect acceleration of gravity so that the LEDs 64R, 64G, and 64B turn off.

A method for determining the luminous color based on the acceleration will now be explained. The CPU 63 determines a luminous color upon referring to the luminous color table for acceleration (FIG. 5) stored in the ROM 66.

FIG. 5 is a diagram showing a luminous color table for acceleration according to the present embodiment. According to FIG. 5, the X-axis corresponds to red, the Y-axis corresponds to green, and the Z-axis corresponds to blue. By referring to the luminous color table for acceleration, the CPU 63 selects the LED 64 corresponding to the acceleration generated in each axial direction and sends drive data to the LED 64.

The luminous color when acceleration is generated on the X-axis and the Y-axis is yellow, which is a combined color of red and green. The luminous color when acceleration is generated on the Y-axis and the Z-axis is cyan, which is a combined color of green and blue. The luminous color when acceleration is generated on the X-axis and the Z-axis is magenta, which is a combined color of red and blue. The luminous color when acceleration is generated on the X-axis, the Y-axis, and the Z-axis is white, which is a combined color of red, green, and blue.

Figure 6:
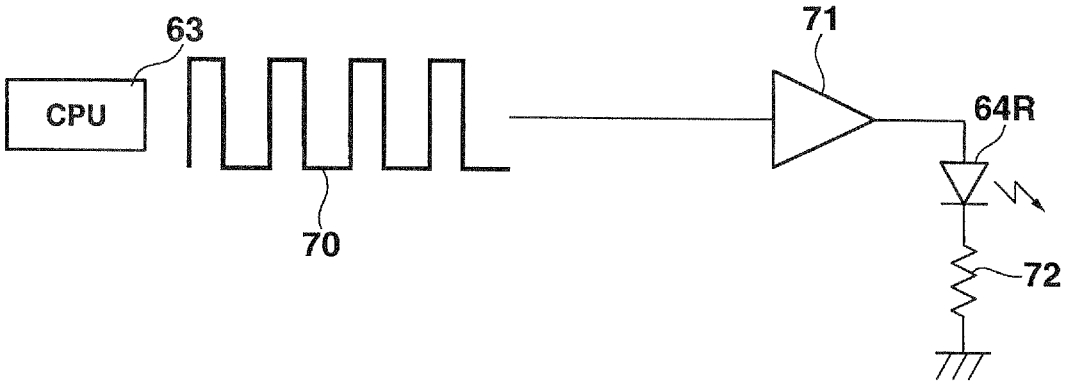
FIG. 6 is a diagram illustrating a constitution when drive data is sent from a CPU 63 to a LED 64R according to an embodiment of the present invention.

Referring to FIG. 6, a constitution when the CPU 63 sends drive data to the LEDs 64R, 64G, and 64B will be explained.

FIG. 6 is a diagram illustrating a constitution when drive data is sent from the CPU 63 to the LED 64R. The embodiments for the LEDs 64G and 64B are the same as that for the LED 64R, and thus illustrations thereof are not repeated.

The CPU 63 outputs a PWM (Pulse Width Modulation) waveform 70, which is drive data, via the drive circuit 71 and sends it to the LED 64R. The LED 64R is grounded via a resistor 72.

The CPU 63 outputs the PWM waveform 70 at a DUTY ratio corresponding to the size of acceleration obtained by the acceleration sensor 61. If the size of acceleration is equal to or greater than a prescribed value $\alpha$, the CPU 63 outputs the PWM waveform 70 at a DUTY ratio of 100%. If the size of acceleration is a value that can be regarded as 0 (hereinafter simply referred to as "0"), the CPU 63 outputs the PWM waveform 70 at a DUTY ratio of 0%. If the size of acceleration is greater than 0 and less than the prescribed value $\alpha$, the CPU 63 outputs such that the DUTY ratio increases as the size of the acceleration increases.

If the DUTY ratio of the PWM waveform 70 is 100%, the drive circuit 71 is configured such that the LEDs 64R, 64G, and 64B emit light at a maximum brightness. If the DUTY ratio is 0%, the drive circuit 71 is configured such that the LEDs 64R, 64G, and 64B do not emit light. If the DUTY ratio is greater than 0% and less than 100%, the drive circuit 71 is configured such that the brightness of the LEDs 64R, 64G, and 64B increases as the DUTY ratio increases.

Figure 7:
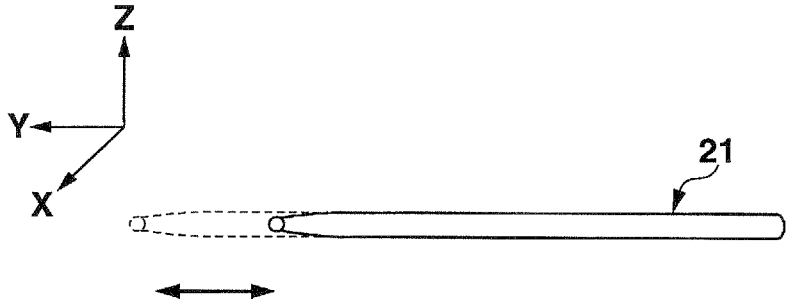
FIG. 7 is a view illustrating an example of a stroke of the stick-type controller 21 according to an embodiment of the present invention.

Therefore, for example, as shown in FIG. 7, if the stick-type controller 21 is stroked in only the Y-axis direction, or in other words, if the stick-type controller 21 does not wobble in the up-down direction (Z-axis direction) and the left-right direction (X-axis direction) from the perspective of the performer, only the LED 64G emits light. As the acceleration in the Y-axis direction increases, the brightness of the LED 64G increases.

Figure 8:
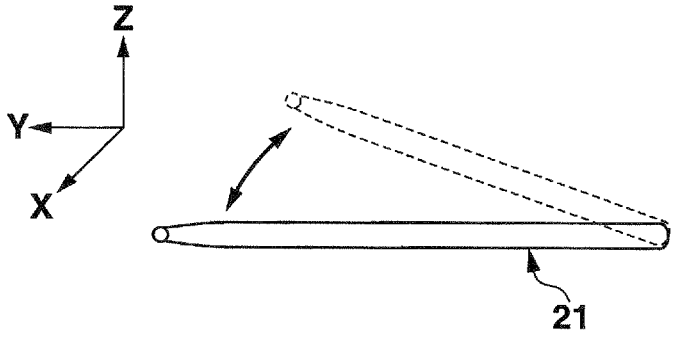
FIG. 8 is a view illustrating an example of a stroke of the stick-type controller 21 according to an embodiment of the present invention.

Further, for example, as shown in FIG. 8, if a stroke in the Z-axis direction is added to the stroke in the Y-axis direction of the stick-type controller 21, or in other words, if the stick-type controller 21 does not wobble in the left-right direction (X-axis direction) from the perspective of the performer, the LEDs 64G and 64B emit light. The LEDs 64 emit cyan-colored light, which is a combined color of green and blue. In this case, if the size of acceleration in the Y-axis direction is larger than the size of acceleration in the Z-axis direction, the brightness of the green color is larger than the brightness of the blue color, and thus although the color is cyan, the proportion of green is higher.

Accordingly, when acceleration is generated in two or more axial directions, the luminous color is a combined color of red, green, or blue, but the hue of the combined color changes depending on the size of the acceleration on each axis.

If the acceleration generated on all three axes of the X-axis, Y-axis, and Z-axis of the stick-type controller 21 is 0 (uniform motion), the CPU 63 outputs the PWM waveform based on the acceleration at 0% for all three axes. Thus, none of the LEDs 64R, 64G, and 64B emit light.

In this case, the CPU 63 performs control to cause the LEDs 64 to emit light in accordance with the size of angular velocity detected by the angular velocity sensor 62.

Referring again to FIG. 4, the luminous color based on the acceleration sensor 62 will now be explained.

If the angular velocity sensor 62 detects angular velocity around the X-axis, the CPU 63 sends drive data to the LED 64G and the LED 64B for causing the LED 64G and the LED 64B to emit light at a brightness in accordance with the size of angular velocity around the X-axis.

The reason for this constitution is explained below. For example, if acceleration is generated only on the Y-axis and the Z-axis of the stick-type controller 21 (in this case, angular velocity is generated only around the X-axis), the LEDs 64 emit a cyan color as explained above in FIG. 8. However, if the motion becomes uniform in this state, the LEDs 64 turn off, but the stick-type controller 21 still moves with a uniform angular velocity around the X-axis. Thus, in order to maintain the emission of cyan-colored light, the CPU 63 sends drive data to the LED 64G and the LED 64B.

Similarly, if the angular velocity sensor 62 detects angular velocity around the Y-axis, the CPU 63 sends drive data to the LED 64R and the LED 64B for causing the LED 64R and the LED 64B to emit light at a brightness in accordance with the size of angular velocity around the Y-axis. Further, if the angular velocity sensor 62 detects angular velocity around the Z-axis, the CPU 63 sends drive data to the LED 64R and the LED 64G for causing the LED 64R and the LED 64G to emit light at a brightness in accordance with the size of angular velocity around the Z-axis.

In the case of angular velocity, the constitution when the CPU 63 sends drive data to the LEDs 64R, 64G, and 64B is the same as that explained above regarding acceleration referring to FIG. 6.

Specifically, the CPU 63 outputs the PWM waveform 70 at a DUTY ratio corresponding to the size of angular velocity obtained by the angular velocity sensor 62. If the size of angular velocity is equal to or greater than a prescribed value β, the CPU 63 outputs the PWM waveform 70 at a DUTY ratio of 100%. If the size of angular velocity is 0, the CPU 63 outputs the PWM waveform 70 at a DUTY ratio of 0%. If the size of angular velocity is greater than 0 and less than a prescribed value β, the CPU 63 outputs such that the DUTY ratio increases as the size of angular velocity increases.

A method for determining the luminous color based on angular velocity will now be explained. The CPU 63 determines a luminous color upon referring to the luminous color table for angular velocity (FIG. 9) stored in the ROM 66.

Figures 9, 10:
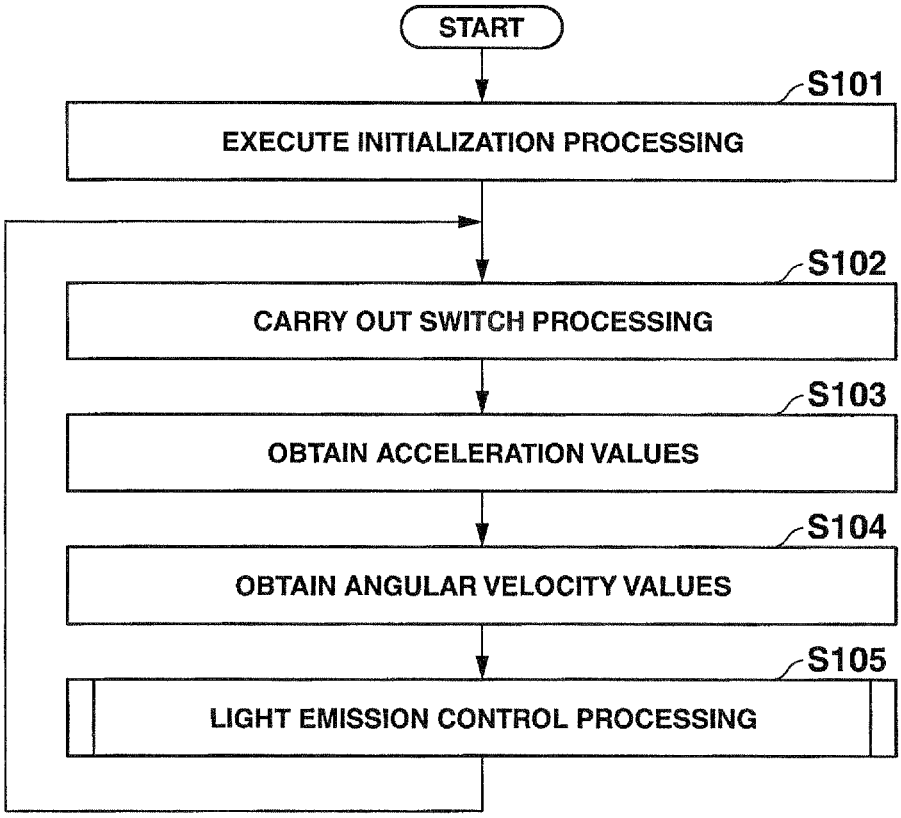
FIG. 9 is a diagram showing a luminous color table for angular velocity according to an embodiment of the present invention.
FIG. 10 is a flowchart illustrating processing executed in the stick-type controller 21 according to an embodiment of the present invention.

FIG. 9 is a diagram showing a luminous color table for angular velocity according to the present embodiment. According to FIG. 9, the X-axis corresponds to cyan, which is a combined color of green and blue, the Y-axis corresponds to magenta, which is a combined color of red and blue, and the Z-axis corresponds to yellow, which is a combined color of red and green. By referring to the luminous color table for angular velocity, the CPU 63 selects the LED 64 corresponding to angular velocity generated in each axial direction and sends drive data to the LED 64.

Below, the processing executed by the CPU 63 of the stick-type controller 21 according to the present embodiment will be explained.

FIG. 10 is a flowchart illustrating processing executed in the stick-type controller 21 according to the present embodiment.

In step S101, the CPU 63 of the stick-type controller 21 executes initialization processing such as clearing the data of the RAM 67.

In step S102, the CPU 63 carries out switch processing. In the switch processing, the CPU 63 executes, for example, the following processing. The CPU 63 executes setting of the musical tone to be produced and the like in accordance with a switching operation of the input unit 69. The CPU 63 stores information of the indicated tone in the RAM 67.

In step S103, the CPU 63 obtains acceleration values from the acceleration sensor 61 and stores them in the RAM 67. As explained above, in the present embodiment, the acceleration sensor 61 is a three-axis sensor, and the CPU 63 obtains acceleration values for each component of the X-axis, the Y-axis, and the Z-axis, and stores these values in the RAM 67.

In step S104, the CPU 63 obtains angular velocity values from the angular velocity sensor 62 and stores them in the RAM 67. As explained above, in the present embodiment, the angular velocity sensor 62 is a three-axis sensor, and the CPU 63 obtains angular velocity values for each component of the X-axis, the Y-axis, and the Z-axis, and stores these values in the RAM 67.

In step S105, the CPU 63 executes light emission control processing. The light emission control processing will be explained below referring to FIG. 11.

Once the CPU 63 completes the light emission control processing, the CPU 63 returns to step S102 and repeats the processing in step S102 and beyond.

Figure 11:
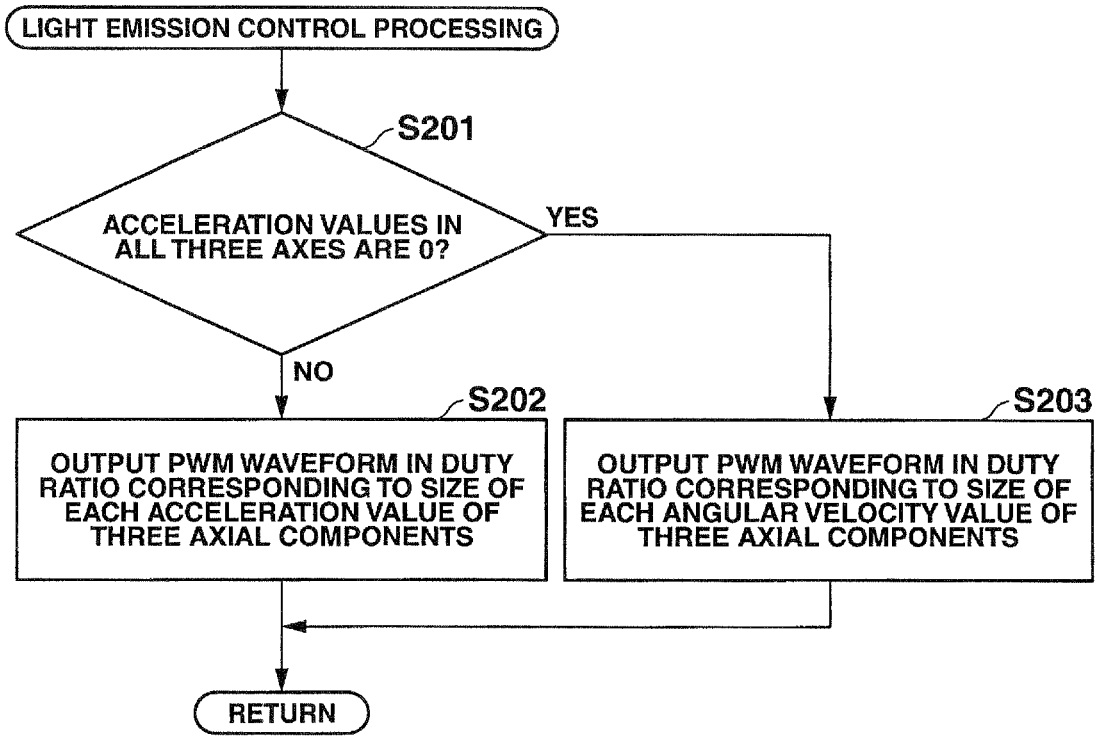
FIG. 11 is a flowchart illustrating light emission control processing according to an embodiment of the present invention.

FIG. 11 is a flowchart illustrating light emission control processing according to the present embodiment.

In step S201, the CPU 63 reads out the acceleration values stored in the RAM 67, and determines whether the acceleration values in all three axes of the X-axis, Y-axis, and Z-axis are 0. If the determination is NO, then the CPU 63 proceeds to step S202. If the determination is YES, then the CPU 63 proceeds to step S203.

In step S202, the CPU 63 outputs a PWM waveform in a DUTY ratio corresponding to the size of each acceleration value of the three axial components of the X-axis, Y-axis, and Z-axis that has been read out.

In detail, as explained above, if the size of the acceleration value is equal to or greater than a prescribed value α, the CPU 63 outputs the PWM waveform at a DUTY ratio of 100%. If the size of acceleration value is 0, the CPU 63 outputs the PWM waveform at a DUTY ratio of 0%. If the size of the acceleration value is greater than 0 and less than the prescribed value α, the CPU 63 outputs such that the DUTY ratio increases as the size of the acceleration value increases.

In step S203, the CPU 63 outputs a PWM waveform in a DUTY ratio corresponding to the size of the each angular velocity value of the three axial components of the X-axis, Y-axis, and Z-axis that has been read out.

In detail, as explained above, the CPU 63 outputs a PWM waveform in a DUTY ratio corresponding to the size of angular velocity obtained by the angular velocity sensor 62. If the size of angular velocity is equal to or greater than a prescribed value β, the CPU 63 outputs the PWM waveform at a DUTY ratio of 100%. If the size of angular velocity is 0, the CPU 63 outputs the PWM waveform at a DUTY ratio of 0%. If the size of angular velocity is greater than 0 and less than a prescribed value β, the CPU 63 outputs such that the DUTY ratio increases as the size of angular velocity increases.

In the present embodiment, if the acceleration value obtained by the acceleration sensor 61 is not 0 on at least one axis among the three axes of the X-axis, the Y-axis, and the Z-axis of the stick-type controller 21, the CPU 63 causes the LEDs 64 to emit light in a color corresponding to the axis or axes on which an acceleration value other than 0 was obtained.

Therefore, for example, if the stick-type controller 21 is stroked in only the Y-axis direction, or in other words, if the stick-type controller 21 does not wobble in the up-down direction (Z-axis direction) and the left-right direction (X-axis direction) from the perspective of the performer, only the LED 64G emits light, and thus the LEDs 64 emit light of a green color.

Further, if a stroke in the Z-axis direction is added to the stroke in the Y-axis direction of the stick-type controller 21, or in other words, if the stick-type controller 21 does not wobble in the left-right direction (X-axis direction) from the perspective of the performer, the LEDs 64G and 64B emit light, and thus the LEDs 64 emit light of a cyan color, which is a combined color of green and blue.

As explained above, since the luminous color of the LEDs 64 changes in accordance with the direction in which the stick-type controller 21 is swung relative to the three axes of the X-axis, the Y-axis, and the Z-axis, the performer can intuitively comprehend the swing direction of the stick-type controller 21.

The present invention can also be utilized as a training device for maintaining a stable stroke during drum performance.

In addition, since drum performances are sometimes carried out on a dark stage in a live music venue or the like, the present invention can also exhibit a performance effect in which the trajectory of the stick-type controller 21 is expressed with a luminous color.

In the present embodiment, the CPU 63 causes the LEDs 64 to emit light at a brightness in accordance with the size of the acceleration value.

Therefore, the performer can intuitively comprehend not only the swing direction of the stick-type controller 21 but also the strength of the swing.

In the present embodiment, if the acceleration values obtained by the acceleration sensor 61 are 0 in all three axes of the X-axis, Y-axis, and Z-axis, the CPU 63 causes the LEDs 64 to emit light of a color corresponding to the axis or axes on which an angular velocity value is obtained by the angular velocity sensor 62.

For example, if the motion of the stick-type controller 21 becomes uniform while it is being stroked in only the Y-axis direction and the Z-axis direction and cyan-colored light is being emitted, the CPU 63 determines that the stick-type controller 21 is moving with a uniform angular velocity around the X-axis and maintains the cyan-colored light emission.

Therefore, the luminous color of the LEDs 64 can be maintained even if the motion becomes uniform.

In the present embodiment, the CPU 63 causes the LEDs 64 to emit light at a brightness in accordance with the size of the angular velocity value.

Therefore, the performer can intuitively comprehend not only the swing direction of the stick-type controller 21 but also the speed of the swing.

In the present embodiment, a constitution in which the stick-type controller 21 is used as a stick for an electronic instrument (electronic drum) was explained. However, the present embodiment is not limited thereto, and it can be installed in a conductor's baton, a baseball bat, a kendo bamboo sword, a golf club, and the like. Thereby, the stick-type controller 21 can be utilized in products that have an objective of confirming the timing or the like of a swing or shot.

In the above, several embodiments of the present invention were explained, but these embodiments are merely examples of the present invention and do not limit the technical scope of the present invention. The present invention can be utilized in various other embodiments, and various modifications such as deletions or substitutions can be made as long as they do not deviate from the spirit of the present invention. These embodiments and modifications are included within the scope and gist of the invention described in the present specification and the like, and are included within a scope equivalent to that of the inventions recited in the claims.

What is claimed is:

1. A controller comprising:

a stick-shaped member, an acceleration sensor that obtains accelerations generated in respective directions of three axes that are mutually orthogonal including an axis in a longitudinal direction of the stick-shaped member, an angular velocity sensor that obtains an angular velocity generated around each of the three axes, a plurality of light emitters that are provided on the stick-shaped member corresponding to each of the three axes, wherein each light emitter is capable of emitting light in a different light-emitting form, and a light emission control unit that controls the light emission of the light emitters in accordance with the acceleration on each of the three axes obtained by the acceleration sensor, wherein the light emission control unit comprises:

an acceleration light emission control unit which, when the stick-shaped member is in a first state, causes the light emitters to emit light at a brightness in accordance with a size of the obtained accelerations generated in the respective directions of the three axes, and an angular velocity light emission control unit which, when the stick-shaped member is in a second state, causes the light emitters to emit light at a brightness in accordance with a size of the obtained angular velocities generated around each of the three axes.

2. The controller according to claim 1, wherein the plurality of light emitters each have a different luminous color.

3. The controller according to claim 1, wherein the light emission control unit further comprises:

a determination unit that determines whether all of the accelerations on the three axes obtained by the acceleration sensor are zero, and a switching unit that causes the light emitters to emit light by the acceleration light emission control unit if the determination unit detects that all of the accelerations on the three axes are not zero, and causes the light emitters to emit light by the angular velocity light emission control unit if the determination unit detects that all of the accelerations on the three axes are zero.

4. The controller according to claim 1, wherein:

the first state is a state in which the acceleration value obtained by the acceleration sensor is not zero on one of the three axes of the stick-shaped member, and the second state is a state in which the acceleration value obtained by the acceleration sensor is zero on all three axes of the stick-shaped member.

5. A method for operating a controller comprising a stick-shaped member, an acceleration sensor that obtains accelerations generated in respective directions of three axes that are mutually orthogonal including an axis in a longitudinal direction of the stick-shaped member, an angular velocity sensor that obtains an angular velocity generated around each of the three axes, and a plurality of light emitters that are provided on the stick-shaped member corresponding to each of the three axes, wherein each light emitter is capable of emitting light in a different light-emitting form, the method comprising:

obtaining accelerations generated in the respective directions of the three axes from the acceleration sensor, when the stick-shaped member is in a first state, controlling light emission of the light emitters in accordance with the acceleration on each of the three axes, obtaining an angular velocity generated around each of the three axes from the angular velocity sensor, and when the stick-shaped member is in a second state, controlling light emission of the light emitters to emit light at a brightness in accordance with a size of the obtained angular velocities generated around each of the three axes.

6. The controller according to claim 5, wherein:

the first state is a state in which the acceleration value obtained by the acceleration sensor is not zero on one of the three axes of the stick-shaped member, and the second state is a state in which the acceleration value obtained by the acceleration sensor is zero on all three axes of the stick-shaped member.

7. A non-transitory computer-readable storage medium that stores a program for controlling a computer used in a controller comprising a stick-shaped member, an acceleration sensor that obtains accelerations generated in respective directions of three axes that are mutually orthogonal including an axis in a longitudinal direction of the stick-shaped member, an angular velocity sensor that obtains angular velocity generated on each of the three axes, and a plurality of light emitters that are provided on the stick-shaped member corresponding to each of the three axes, wherein each light emitter is capable of emitting light in a different light-emitting form, said program controlling said computer to execute functions comprising:

obtaining accelerations generated in the respective directions of the three axes from the acceleration sensor, when the stick-shaped member is in a first state, controlling light emission of the light emitters in accordance with the acceleration on each of the three axes, obtaining angular velocities sensor generated around each of the three axes from the angular velocity sensor, and when the stick-shaped member is in a second state, controlling light emission of the light emitters to emit light at a brightness in accordance with a size of the obtained angular velocities generated around each of the three axes.

8. The controller according to claim 7, wherein:

the first state is a state in which the acceleration value obtained by the acceleration sensor is not zero on one of the three axes of the stick-shaped member, and the second state is a state on which the acceleration value obtained by the acceleration sensor is zero on all three axes of the stick-shaped member.

* * * * *